US012571399B1

(12) United States Patent
Jian

(10) Patent No.: US 12,571,399 B1
(45) Date of Patent: Mar. 10, 2026

(54) HANDHELD FAN

(71) Applicant: Haibo Jian, Shaoyang (CN)

(72) Inventor: Haibo Jian, Shaoyang (CN)

( * ) Notice: Subject to any disclaimer, the term of this patent is extended or adjusted under 35 U.S.C. 154(b) by 0 days.

(21) Appl. No.: 19/194,275

(22) Filed: Apr. 30, 2025

(51) Int. Cl.

| | |
|---|---|
| ***F04D 25/08*** | (2006.01) |
| ***F04D 25/06*** | (2006.01) |
| ***F04D 29/52*** | (2006.01) |
| ***F04D 29/64*** | (2006.01) |
| ***F04D 29/70*** | (2006.01) |

(52) U.S. Cl.
CPC ..... *F04D 25/084* (2013.01); *F04D 25/0673* (2013.01); *F04D 29/522* (2013.01); *F04D 29/644* (2013.01); *F04D 29/703* (2013.01)

(58) Field of Classification Search
CPC .. F04D 25/084; F04D 25/0673; F04D 29/522; F04D 29/644; F04D 29/703
USPC ..... 34/523
See application file for complete search history.

(56) References Cited

U.S. PATENT DOCUMENTS

| | | | | |
|---|---|---|---|---|
| 11,566,628 | B1 * | 1/2023 | Liu | F04D 19/002 |
| 2007/0097629 | A1 * | 5/2007 | Vinson | H05K 7/20172 361/695 |
| 2011/0058945 | A1 * | 3/2011 | Hu | F03D 1/00 362/249.02 |
| 2022/0049708 | A1 * | 2/2022 | Kaidu | G06F 1/206 |
| 2023/0265854 | A1 * | 8/2023 | Chen | F04D 19/002 416/63 |
| 2024/0229809 | A1 * | 7/2024 | Zheng | F04D 29/547 |

* cited by examiner

*Primary Examiner* — Connor J Tremarche
(74) *Attorney, Agent, or Firm* — JEEN IP LAW, LLC

(57) ABSTRACT

A handheld fan is provided, including a housing body. The housing body includes a hand grip portion, an air duct portion is disposed in the housing body, a motor is disposed in the air duct portion, a motor circuit board is disposed on the motor, and the motor circuit board is electrically connected to the motor. A control circuit board and a battery are further disposed in the housing body, the control circuit board is electrically connected to the motor circuit board, and the control circuit board is electrically connected to the battery. According to the above structural configuration of the handheld fan, the motor circuit board and control circuit board are separately disposed in the housing body, so that heat generated by the motor circuit board and control circuit board is distributed across distinct components. Additionally, the motor circuit board is independently disposed on the motor.

12 Claims, 11 Drawing Sheets

HANDHELD FAN

TECHNICAL FIELD

The present disclosure relates to the field of fans, and in particular to a handheld fan.

BACKGROUND

Currently, a type of handheld fan that operates at high rotational speeds to deliver strong airflow appears in the market, which is commonly referred to as a "high-performance fan" or "high-speed fan" in the industry. Such handheld fans are typically used for applications, including rapid dust removal, accelerated heat dissipation, and quick drying. However, in the prior art, such handheld fans employ only a single circuit board electrically connected to a motor. A high operational speed of the motor induces significant thermal generation in the single circuit board, which adversely affects a service life of the handheld fans. Consequently, achieving effective heat dissipation has remained a persistent technical challenge in products of this category.

SUMMARY

In order to overcome shortcomings in the prior art, the present disclosure provides a handheld fan.

Technical solutions adopted by the present disclosure to address corresponding technical problems are as follows.

The present disclosure provides the handheld fan, including a housing body. The housing body includes a hand grip portion, an air duct portion is disposed in the housing body, a motor is disposed in the air duct portion, a motor circuit board is disposed on the motor, and the motor circuit board is electrically connected to the motor. A control circuit board and a battery are further disposed in the housing body, the control circuit board is electrically connected to the motor circuit board, and the control circuit board is electrically connected to the battery.

Furthermore, both the control circuit board and the battery are disposed in the hand grip portion.

Furthermore, the air duct portion is horizontally disposed, the hand grip portion is vertically disposed, and the hand grip portion is connected to a bottom portion of the air duct portion to form a T-shaped structure of the housing body.

Furthermore, a first end of the air duct portion forms an air outlet, a second end of the air duct portion forms an air inlet, the air outlet and the air inlet are opposite to form a convection structure of the air duct portion.

Furthermore, protective grilles are respectively disposed at the air outlet and the air inlet.

Furthermore, the handheld fan further includes a first connecting wire, a wiring hole is defined at a junction between the air duct portion and the hand grip portion. A first end of the first connecting wire is electrically connected to the control circuit board, and a second end of the first connecting wire passes through the wiring hole to electrically connect to the motor circuit board for achieving electrical connection between the control circuit board and the motor circuit board.

Furthermore, a second connecting wire is disposed in the hand grip portion, a first end of the second connecting wire is electrically connected to the control circuit board, and a second end of the second connecting wire is electrically connected to the battery.

Furthermore, a charging interface is disposed on the control circuit board for charging the battery, and the charging interface is externally exposed on the hand grip portion.

Furthermore, an operational button is disposed on the control circuit board, and the operational button is externally exposed on the hand grip portion.

Furthermore, the motor circuit board is a driving circuit board for the motor.

Furthermore, the motor circuit board is disposed corresponding to a central portion of the motor.

Furthermore, the motor includes a rotor portion and a stator portion, the rotor portion is disposed at the central portion of the motor, and the stator portion is disposed surrounding the rotor portion. The motor circuit board is disposed corresponding to the rotor portion of the motor, and the motor circuit board is disposed on the stator portion of the motor.

Furthermore, the motor circuit board is disposed on a front end of the rotor portion of the motor.

Furthermore, the motor further includes a fan blade, the fan blade includes a central connecting portion and peripheral blade portions, the fan blade is connected to a rear end of the rotor portion of the motor through the central connecting portion.

Furthermore, the stator portion of the motor includes ventilation channels corresponding to the peripheral blade portions.

Furthermore, the stator portion of the motor includes a mounting bracket, the mounting bracket is disposed corresponding the rotor portion of the motor and is positioned at a front end of the rotor portion of the motor, the motor circuit board is disposed on the mounting bracket.

Furthermore, at least three supporting rods extend forward from the mounting bracket, and the motor circuit board is connected to terminal ends of the at least three supporting rods.

Furthermore, a rotational speed of the motor is not less than 20,000 PRM. A power rating of the motor is not less than 35 W.

Furthermore, the motor is a three-phase motor.

Furthermore, the handheld fan is a high-speed handheld fan.

Beneficial effects of the present disclosure are as follows.

According to the above structural configuration of the handheld fan, the motor circuit board and control circuit board are separately disposed in the housing body, so that heat generated by the motor circuit board and control circuit board is distributed across distinct components. Additionally, the motor circuit board is independently disposed on the motor. Since the motor is disposed in the air duct portion, during operation, the motor drives rapid airflow through the air duct portion, enabling swift heat dissipation from the motor circuit board. In summary, the handheld fan of the present disclosure achieves effective heat dissipation by dispersing heat and rapid airflow flowing, so as to better solve a problem of poor heat dissipation in current handheld fans, thereby prolonging a service life thereof.

BRIEF DESCRIPTION OF DRAWINGS

In order to more clearly illustrate technical solutions in embodiments of the present disclosure, accompanying drawings required in description of the embodiments are briefly described below, and the accompanying drawings in the following description are merely some embodiments of the present disclosure, and for those who skilled in the art, other drawings may be obtained according to these accompanying drawings without creative efforts.

The present disclosure is further described below with reference to the accompanying drawings and embodiments.

DETAILED DESCRIPTION OF EMBODIMENTS

Figure 1:
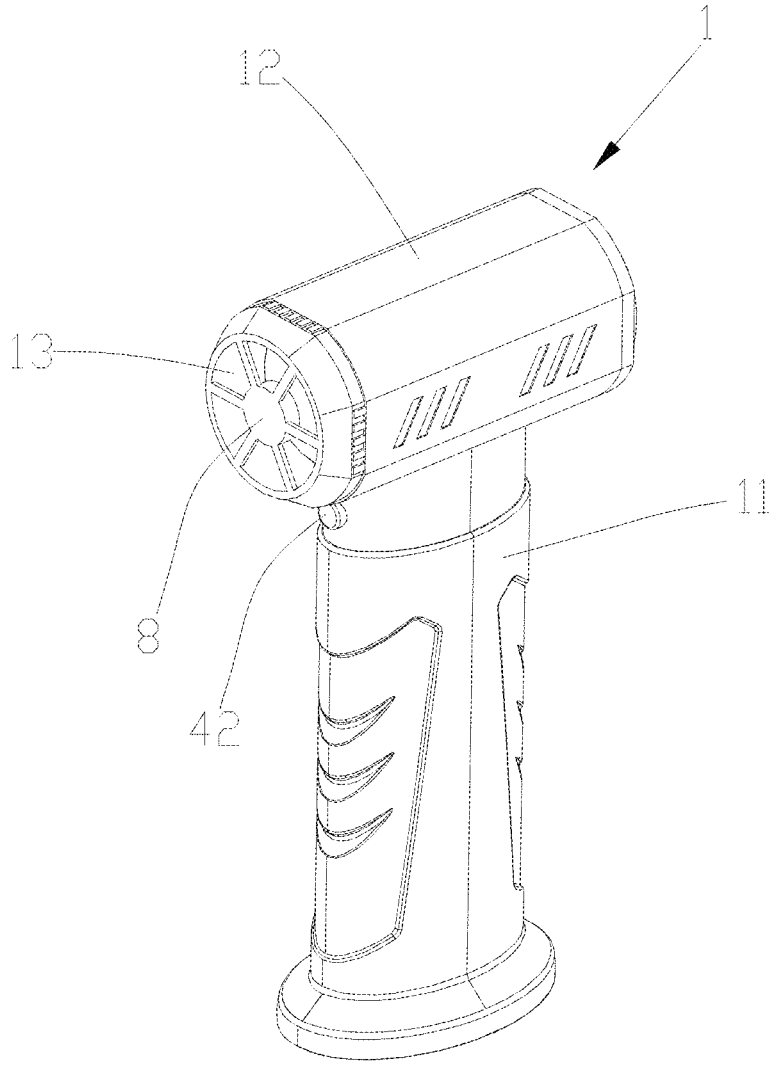
FIG. 1 is a three-dimensional structural schematic diagram of the present disclosure.
Figure 2:
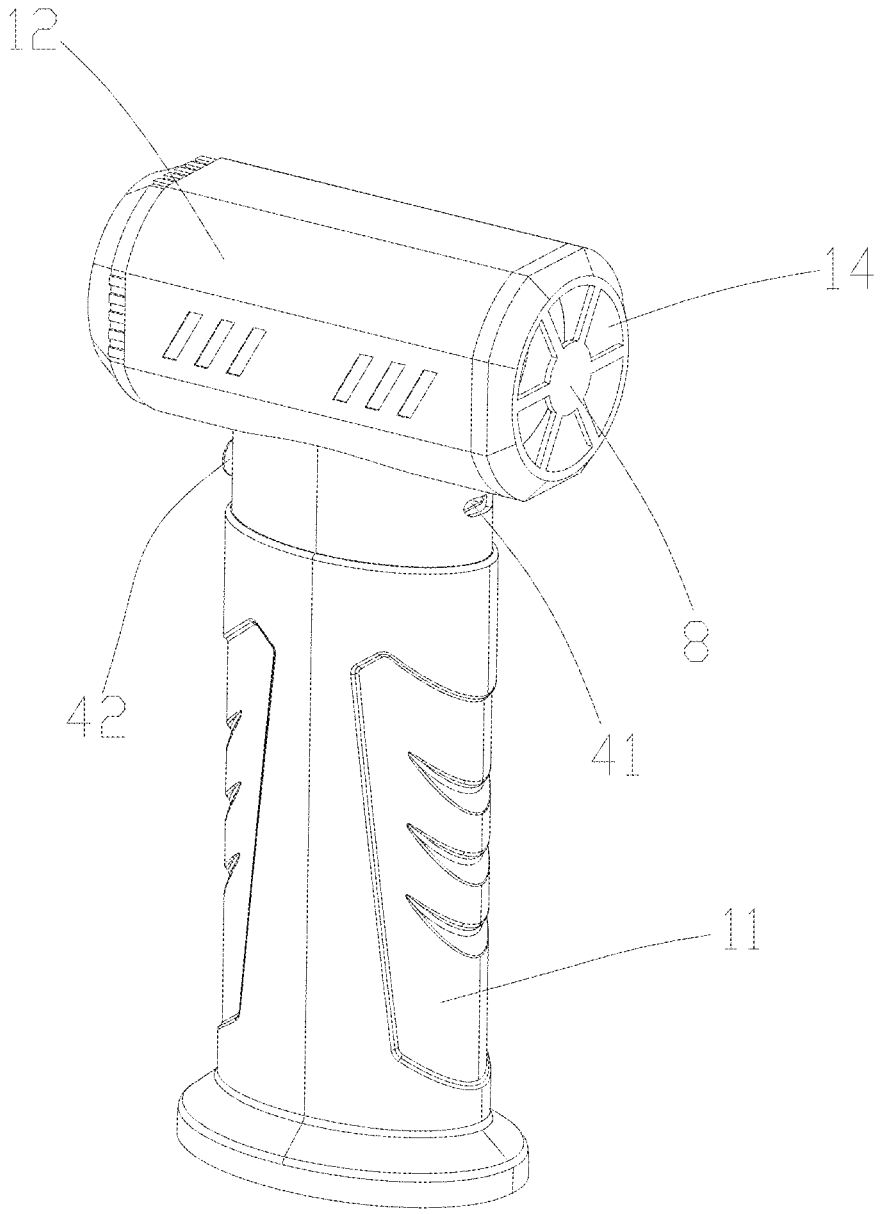
FIG. 2 is another three-dimensional structural schematic diagram of the present disclosure.
Figure 3:
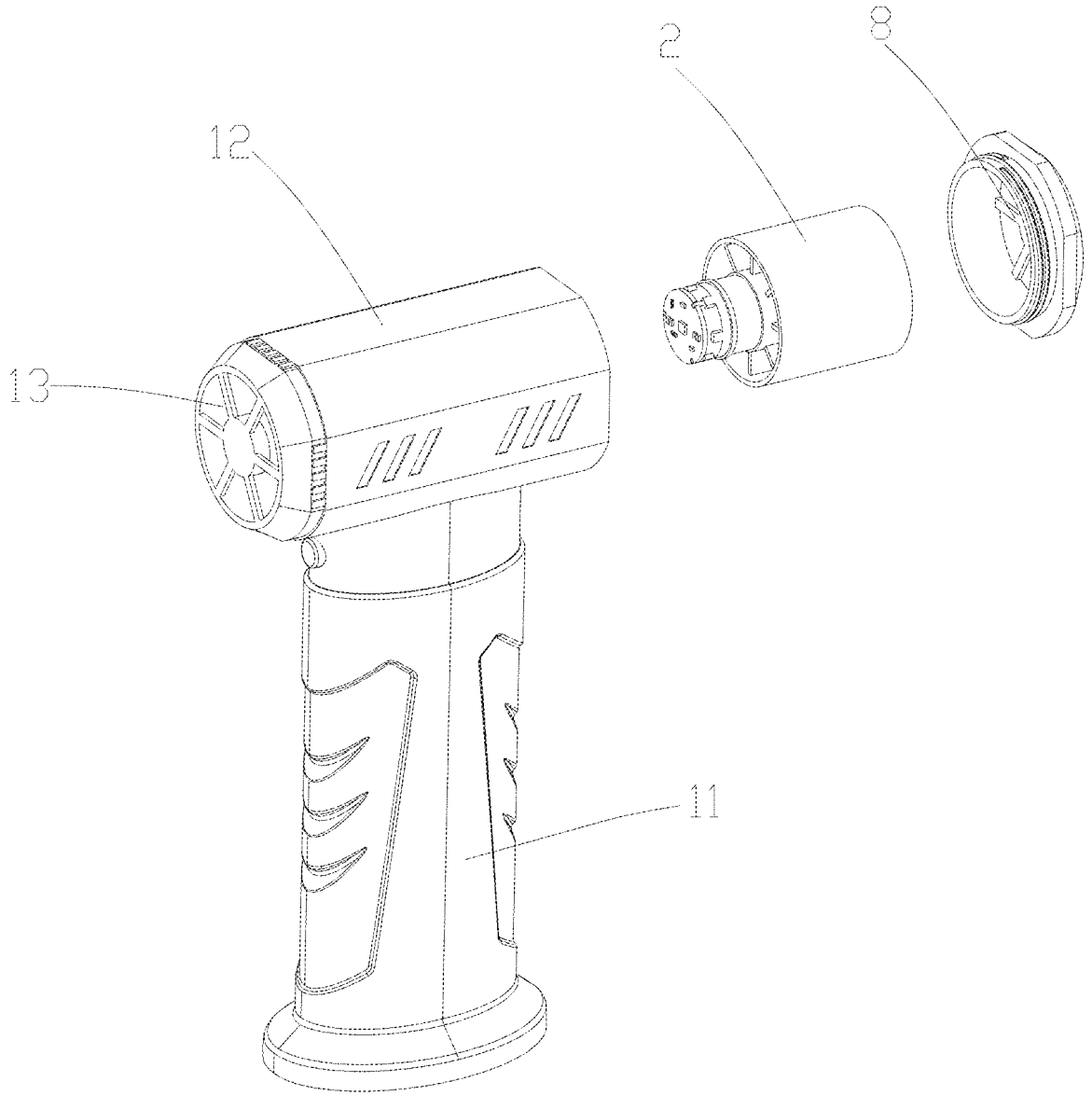
FIG. 3 is an exploded three-dimensional schematic diagram of the present disclosure.
Figure 4:
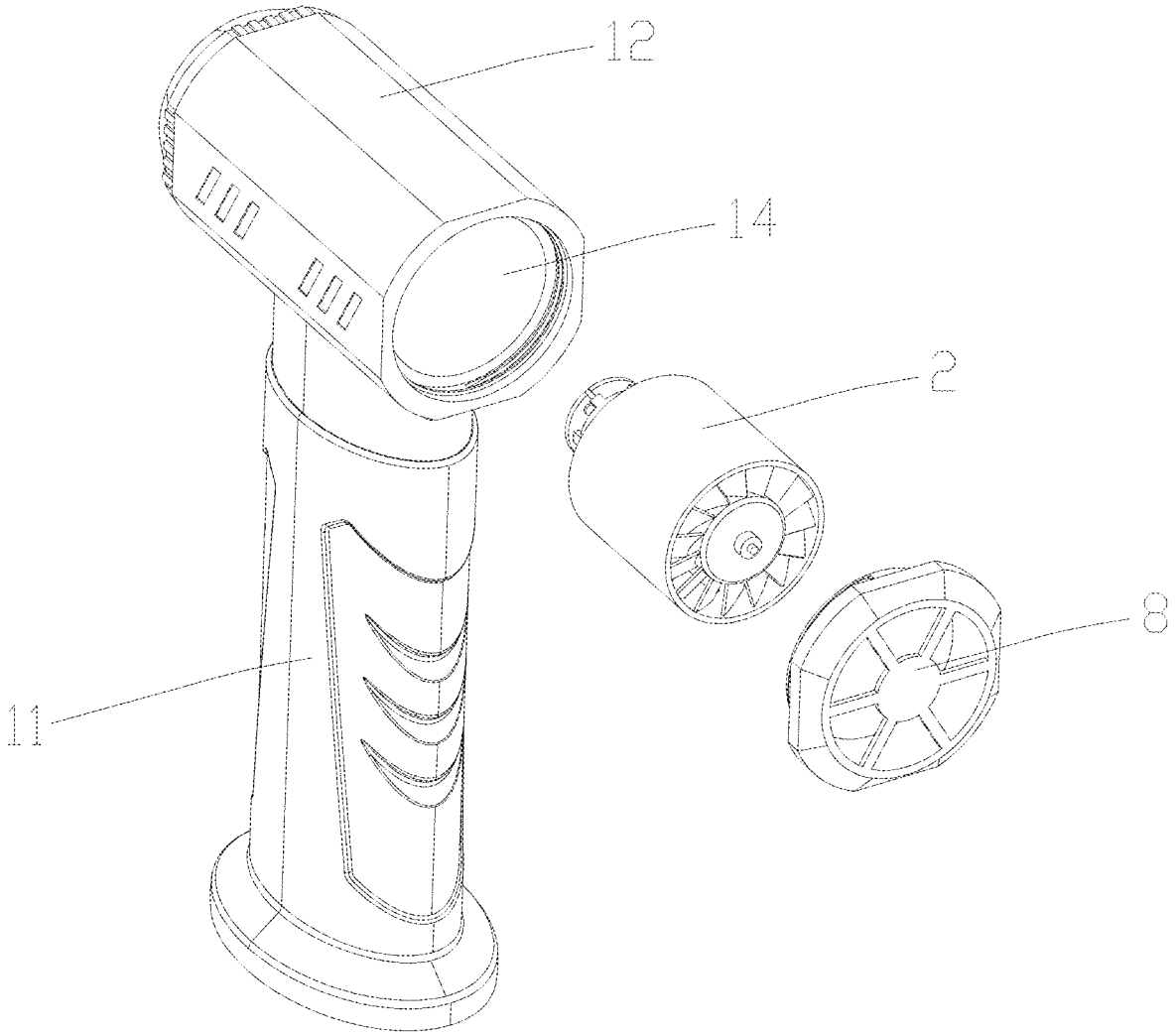
FIG. 4 is another exploded three-dimensional schematic diagram of the present disclosure.
Figure 5:
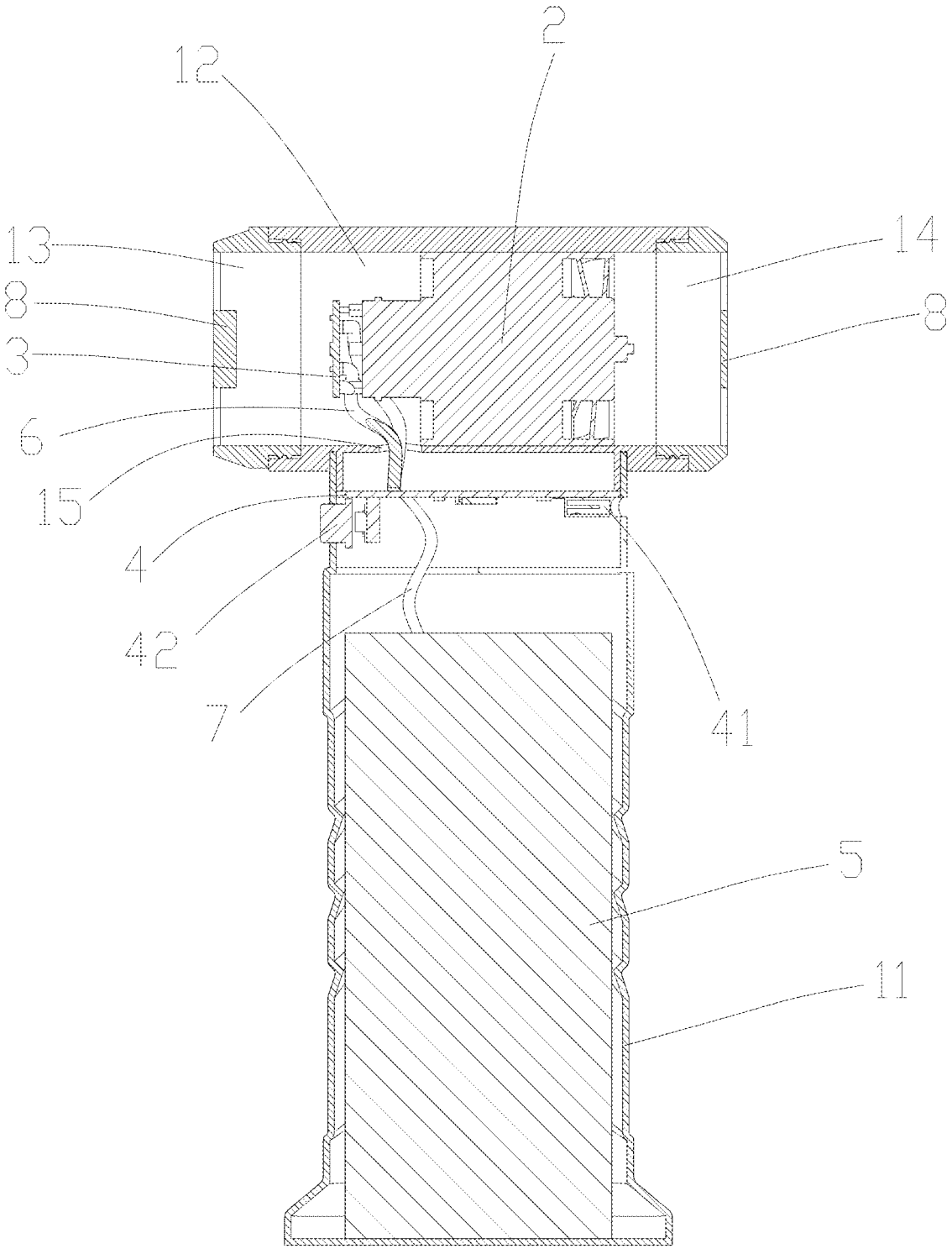
FIG. 5 is a cross-sectional schematic diagram of the present disclosure.
Figure 6:
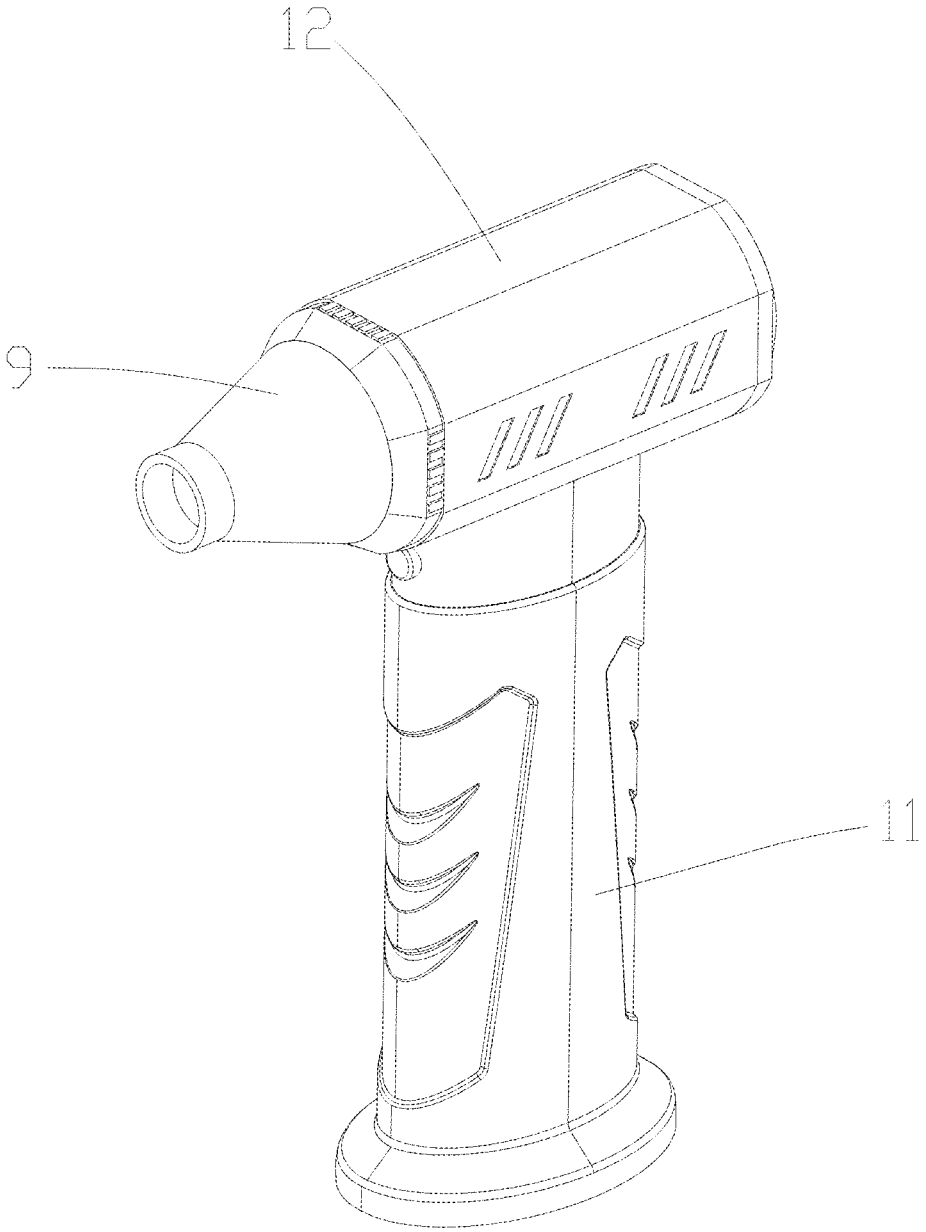
FIG. 6 is a structural schematic diagram of the present disclosure where an air outlet nozzle is provided.
Figure 7:
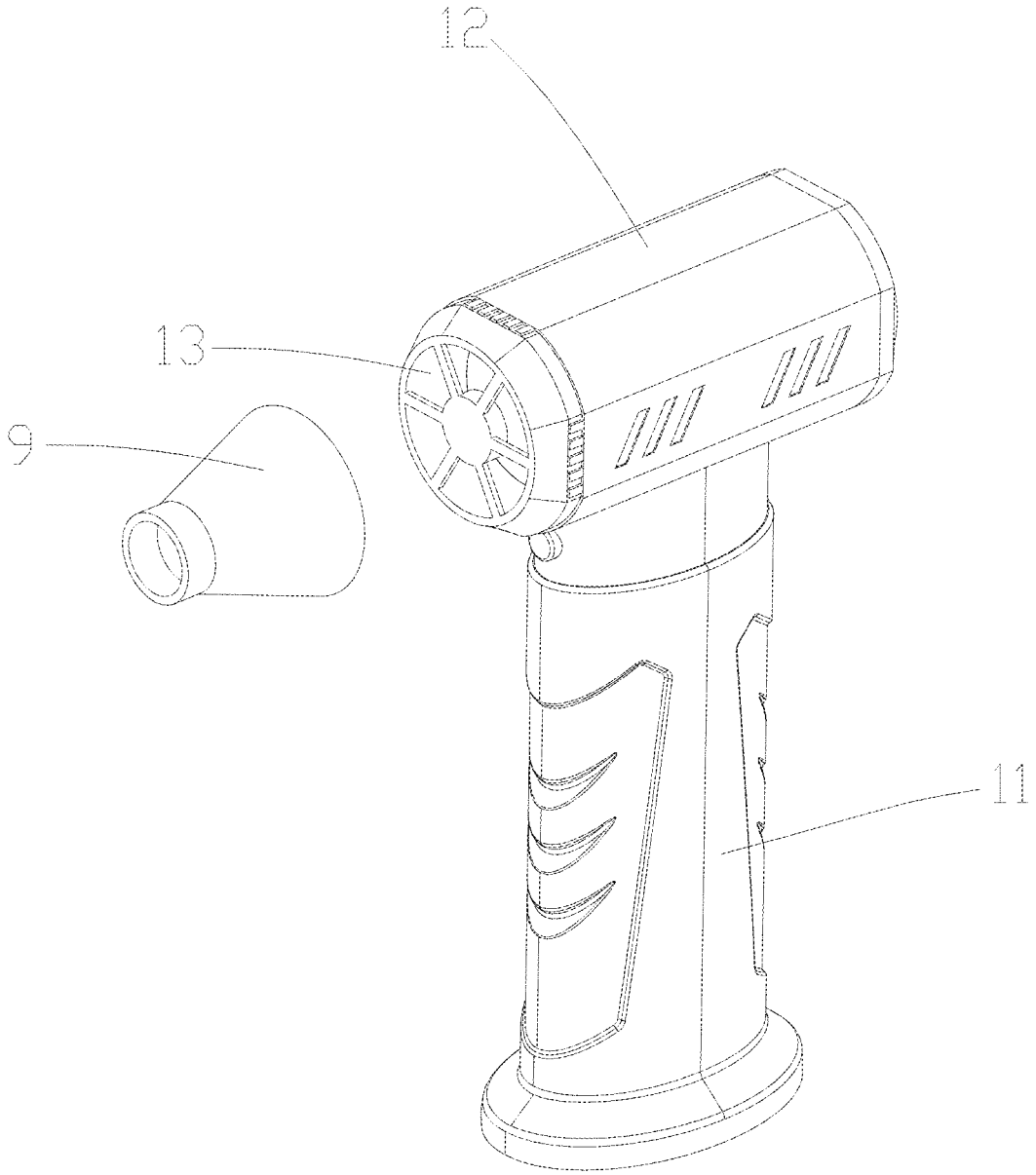
FIG. 7 is an exploded schematic diagram of FIG. 6.
Figure 8:
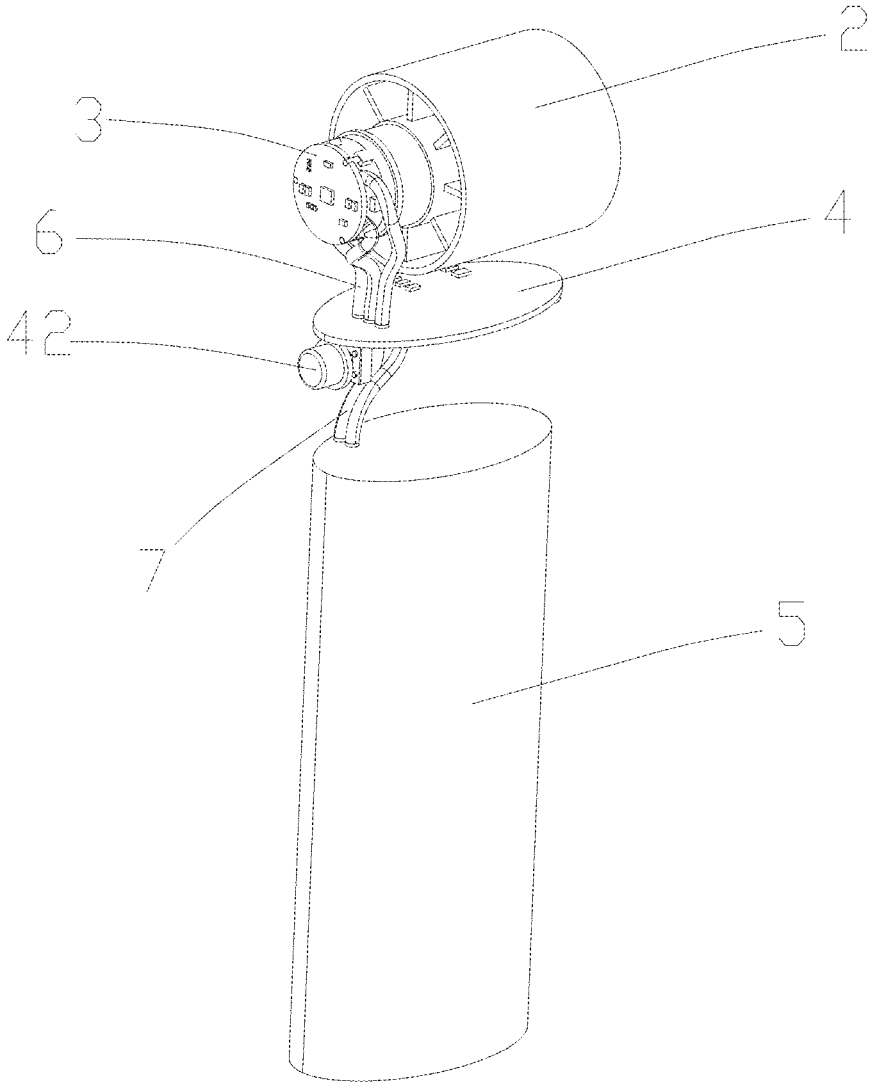
FIG. 8 is a three-dimensional structural schematic diagram illustrating electrical connection between components of the present disclosure.
Figure 9:
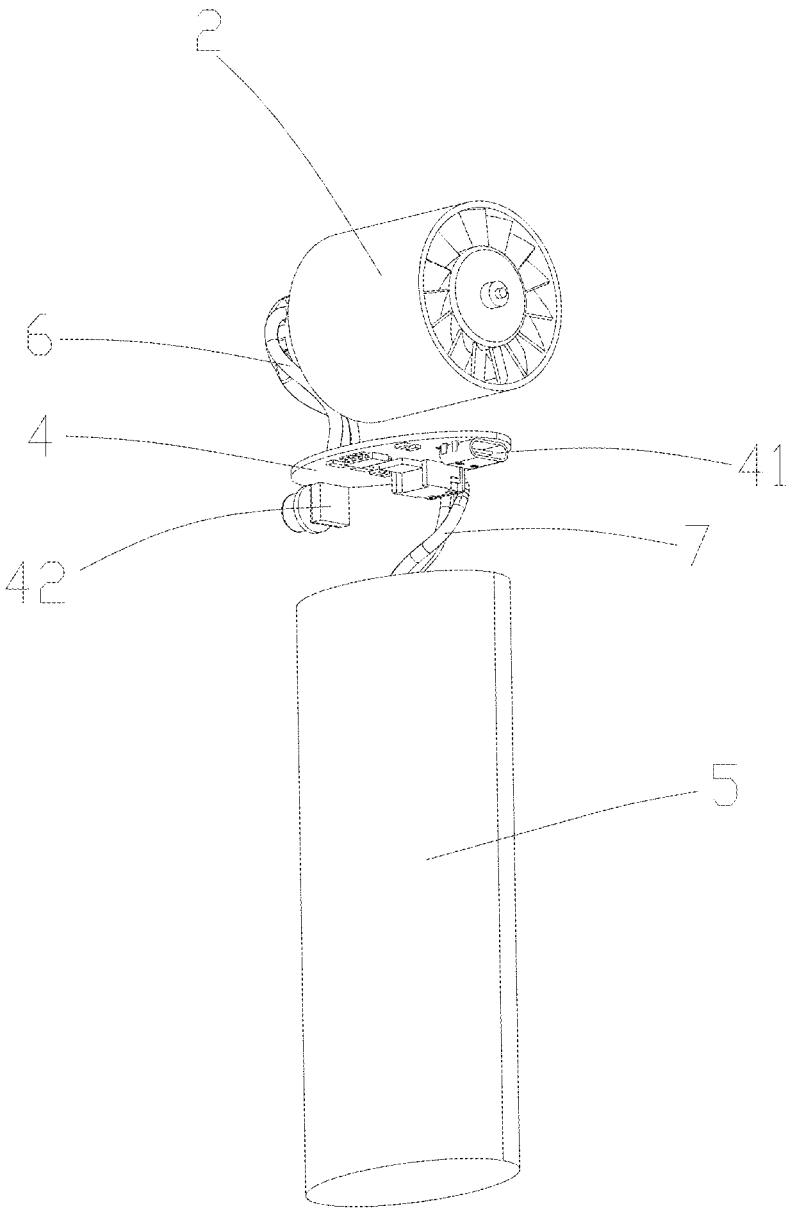
FIG. 9 is another three-dimensional structural schematic diagram illustrating the electrical connection between the components of the present disclosure.
Figure 10:
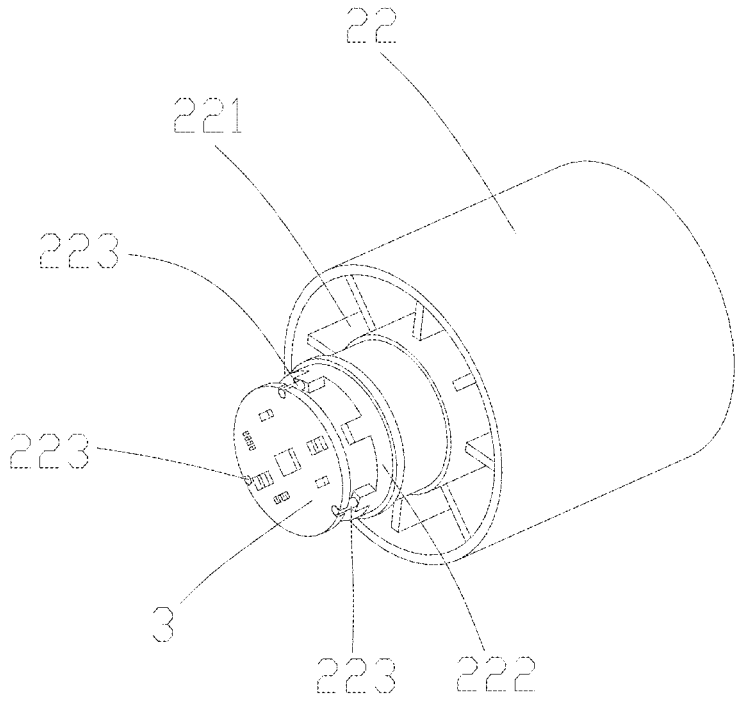
FIG. 10 is a three-dimensional structural schematic diagram of a motor circuit board and a motor of the present disclosure.
Figure 11:
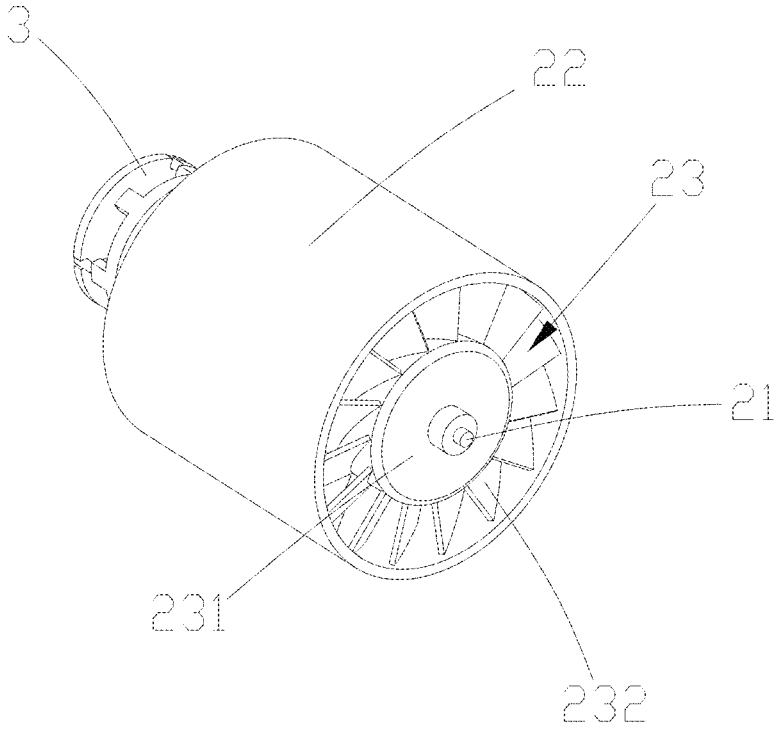
FIG. 11 is another three-dimensional structural schematic diagram of the motor circuit board and the motor of the present disclosure.
Figure 12:
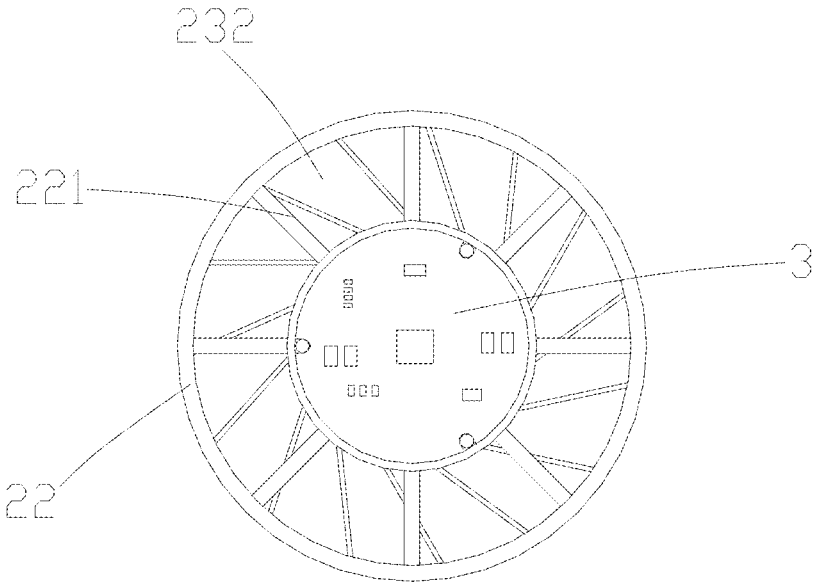
FIG. 12 is a schematic diagram illustrating a projection of the motor circuit board relative to the motor.

Please refer to FIGS. 1-12, a handheld fan is provided, including a housing body 1. The housing body 1 includes a hand grip portion 11, an air duct portion 12 is disposed in the housing body 1, a motor 2 is disposed in the air duct portion 12, a motor circuit board 3 is disposed on the motor 2, and the motor circuit board 3 is electrically connected to the motor 2. A control circuit board 4 and a battery 5 are further disposed in the housing body 1, the control circuit board 4 is electrically connected to the motor circuit board 3, and the control circuit board 4 is electrically connected to the battery 5.

According to the above structural configuration, the motor circuit board 3 and control circuit board 4 are separately disposed in the housing body 1, so that heat generated by the motor circuit board 3 and control circuit board 4 is distributed across distinct components. Additionally, the motor circuit board 3 is independently disposed on the motor 2. Since the motor 2 is disposed in the air duct portion 12, during operation, the motor 2 drives rapid airflow through the air duct portion 12, enabling swift heat dissipation from the motor circuit board 3. In summary, the handheld fan of the present disclosure achieves effective heat dissipation by dispersing heat and rapid airflow flowing, so as to better solve a problem of poor heat dissipation in current handheld fans, thereby prolonging a service life thereof.

Furthermore, the motor circuit board 3 is a driving circuit board for the motor 2. Under a condition that the motor 2 needs to have a high rotational speed, the motor 2 necessarily needs to achieve higher power, so that the heat generated in the handheld fan is mainly concentrated on the motor circuit board 3. Therefore, the motor circuit board 3 is independently disposed on the motor 2 to ensure that the motor circuit board 3 rapidly and effectively dissipates heat, a structural design of which is reasonable.

Specifically, both the control circuit board 4 and the battery 5 are disposed in the hand grip portion 11.

Furthermore, the air duct portion 12 is horizontally disposed, the hand grip portion 11 is vertically disposed, and the hand grip portion 11 is connected to a bottom portion of the air duct portion 12 to form a T-shaped structure of the housing body 1. Through the above structural configuration, a structural design of the handheld fan is more reasonable to facilitate a handheld blowing operation thereof.

Furthermore, a first end of the air duct portion 12 forms an air outlet 13, a second end of the air duct portion 12 forms an air inlet 14, the air outlet 13 and the air inlet 14 are opposite to form a convection structure of the air duct portion 12. In this way, wind force of the handheld fan is improved and optimal airflow performance of the handheld fan is ensured.

Furthermore, protective grilles 8 are respectively disposed at the air outlet 13 and the air inlet 14 to prevent accidental insertion of fingers into the air duct portion 12 and contact with the motor 2, thereby avoiding potential hazards. The protective grilles 8 are threadedly connected to the air outlet 13 or air inlet 14, or the protective grilles 8 are integrally formed with the air outlet 13 or air inlet 14, which is not limited herein. Additionally, an air outlet nozzle 9 for converging airflow is disposed at the air outlet 13. The air outlet nozzle 9 is fixed to the air outlet 13 by various means, including magnetic attraction or threaded connection, without being specifically limited thereto.

The handheld fan further includes a first connecting wire 6, a wiring hole 15 is defined at a junction between the air duct portion 12 and the hand grip portion 11. A first end of the first connecting wire 6 is electrically connected to the control circuit board 4, and a second end of the first connecting wire 6 passes through the wiring hole 15 to electrically connect to the motor circuit board 3 for achieving electrical connection between the control circuit board 4 and the motor circuit board 3, which is simple in structure and reasonable in design.

Furthermore, a second connecting wire 7 is disposed in the hand grip portion 11, a first end of the second connecting wire 7 is electrically connected to the control circuit board 4, and a second end of the second connecting wire 7 is electrically connected to the battery 5. In the above structure, the battery 5 charges the motor 2 through the control circuit board 4 and the motor circuit board 3, and the control circuit board 4 is configured to control the motor circuit board 3 and the motor 2, which is simple in structure and reasonable in design.

Furthermore, a charging interface 41 is disposed on the control circuit board 4 for charging the battery 5, and the charging interface 41 is externally exposed on the hand grip portion 11.

Furthermore, an operational button 42 is disposed on the control circuit board 4, and the operational button 42 is externally exposed on the hand grip portion 11, the operational button 42 is configured to control and operate the motor 2, such as functioning as a power switch or for adjusting fan speed settings.

The motor circuit board 3 is disposed corresponding to a central portion of the motor 2. During operation of the motor 2, airflow predominantly occurs in non-central areas of the motor 2. By positioning the motor circuit board 3 at the central portion of the motor 2, the motor circuit board 3 does not directly obstruct an airflow path, allowing the rapid airflow flowing around a periphery of the motor circuit board 3, thereby enabling efficient heat removal from the motor circuit board 3. Such structural configuration is achieved while simultaneously preserving airflow performance of the handheld fan, which is reasonable and ingenious in structural design.

Furthermore, the motor 2 includes a rotor portion 21 and a stator portion 22, the rotor portion 21 is disposed at the central portion of the motor 2, and the stator portion 21 is disposed surrounding the rotor portion 21. The motor circuit board 3 is disposed corresponding to the rotor portion 21 of the motor 2, and the motor circuit board 3 is disposed on the stator portion 22 of the motor 2.

Furthermore, the motor circuit board 3 is disposed on a front end of the rotor portion 21 of the motor 2. In this structure, the motor circuit board 3 is not connected with the front end of the rotor portion 21 of the motor 2, and is only located at the front end of the rotor portion 21 of the motor 2, which is beneficial to a structural layout.

Furthermore, the motor 2 further includes a fan blade 23, the fan blade 23 includes a central connecting portion 231 and peripheral blade portions 232, the fan blade 23 is connected to a rear end of the rotor portion 21 of the motor 2 through the central connecting portion 231. During use, the motor 2 drives the central connecting portion 231 of the fan blade 23 to rotate through the rotor portion 21, so as to drive the peripheral blade portions 232 of the fan blade 23 to rotate, so as to generate the airflow. In this structure, the airflow predominantly occurs at positions corresponding to the peripheral blade portions 232, that is, the non-central areas of the motor 2.

Furthermore, the stator portion 22 of the motor 2 includes ventilation channels 221 corresponding to the peripheral blade portions 232 of the fan blade 23 to guide the airflow to ensure the airflow performance of the handheld fan. In this way, in the operation of the motor 2, the airflow flows through the air inlet 14, the ventilation channels 221, and the air outlet 15 in sequence, so as to achieve the airflow performance of the handheld fan.

Furthermore, the stator portion 22 of the motor 2 includes a mounting bracket 222, the mounting bracket 222 is disposed corresponding the rotor portion 21 of the motor 2 and is positioned at a front end of the rotor portion 21 of the motor 2, the motor circuit board 3 is disposed on the mounting bracket 222. Similarly, the mounting bracket 222 does not obstruct the airflow path to ensure the airflow performance of the handheld fan. Specifically, the mounting bracket 222 is integrally disposed on the rotor portion 21, or is disposed on the rotor portion 21 in such a manner as to be bonded, snap-fitted, etc., which is not specifically limited herein.

Furthermore, at least three supporting rods 223 extend forward from the mounting bracket 222, and the motor circuit board 3 is connected to terminal ends of the at least three supporting rods 223, which is simple and stable in structure.

In the present disclosure, as a "high-performance fan" or "high-speed fan", the motor 2 needs to operate at a rotational speed not less than 20,000 RPM during actual use to achieve required airflow performance. That is, the handheld fan is a high-speed handheld fan.

The motor 2 is a three-phase motor. In some others embodiments, the motor 2 is selected from other high-speed capable motor types.

Correspondingly, for the "high-performance fan" or "high-speed fan", the motor 2 requires a power rating not less than 35 W due to the high rotational speed thereof. During actual use, the battery 5 typically outputs a voltage of 7.4V, resulting in a current approaching 5 A. Under these conditions, the motor 2 attains a necessary rotational speed to achieve the required airflow performance. Concurrently, the motor circuit board 3 generates significant heat under such operational parameters. Therefore, the motor circuit board 3 is independently disposed on the motor 2 in the air duct portion 12 to achieve rapid and effective heat dissipation. Furthermore, the heat generated by the motor circuit board does not adversely affect other electronic components.

The above descriptions present one or more embodiments in conjunction with specific implementations, but shall not be construed as limiting practical implementations of the present disclosure to these illustrations. All methods, structures, or technical equivalents approximating, or resembling those of the present disclosure, as well as any technical derivations or substitutions made based on an inventive concept of the present disclosure, shall fall within a protection scope claimed herein.

What is claimed is:

1. A handheld fan, comprising:

a housing body;

wherein the housing body comprises a hand grip portion, an air duct portion is disposed in the housing body, a motor is disposed in the air duct portion, a motor circuit board is disposed on the motor, and the motor circuit board is electrically connected to the motor; and a control circuit board and a battery are further disposed in the housing body, the control circuit board is electrically connected to the motor circuit board, and the control circuit board is electrically connected to the battery;

wherein a first end of the air duct portion forms an air outlet, a second end of the air duct portion forms an air inlet, wherein the air outlet and the air inlet are disposed opposite to each other to form a convection structure of the air duct portion;

wherein the motor circuit board is exposed to air inside the air duct portion of the housing body, and wherein a space defined between the motor circuit board, the air outlet of the air duct portion, and sidewalls of the air duct portion is a void, so that heat generated by the motor circuit board during operation is operative to be dissipated by an airflow produced by the motor;

wherein the motor circuit board is disposed corresponding to a central portion of the motor; wherein the motor comprises a rotor portion and a stator portion, the rotor portion is disposed at the central portion of the motor, and the stator portion is disposed surrounding the rotor portion; and the motor circuit board is disposed corresponding to the rotor portion of the motor, and the motor circuit board is disposed on the stator portion of the motor;

wherein the motor circuit board is disposed on a front end of the rotor portion of the motor;

wherein the stator portion of the motor comprises a mounting bracket, the mounting bracket is disposed corresponding the rotor portion of the motor and is positioned at a front end of the rotor portion of the motor, the motor circuit board is disposed on the mounting bracket;

wherein at least three supporting rods extend forward from the mounting bracket, and the motor circuit board is connected to terminal ends of the at least three supporting rods;

wherein the motor circuit board comprises at least three notches or slots that are disposed in one-to-one correspondence with the at least three supporting rods, that extend forward from the mounting bracket, wherein the at least three supporting rods are configured to be inserted into the three notches or slots in the motor circuit board so as to connect the motor circuit board to the mounting bracket.

2. The handheld fan according to claim 1, wherein the air duct portion is horizontally disposed, the hand grip portion is vertically disposed, and the hand grip portion is connected to a bottom portion of the air duct portion to form a T-shaped structure of the housing body.

3. The handheld fan according to claim 1, wherein protective grilles are respectively disposed at the air outlet and the air inlet.

4. The handheld fan according to claim 2, wherein the handheld fan further comprises a first connecting wire, a wiring hole is defined at a junction between the air duct portion and the hand grip portion; and a first end of the first connecting wire is electrically connected to the control circuit board, and a second end of the first connecting wire passes through the wiring hole to electrically connect to the motor circuit board for achieving electrical connection between the control circuit board and the motor circuit board.

5. The handheld fan according to claim 1, wherein a second connecting wire is disposed in the hand grip portion, a first end of the second connecting wire is electrically connected to the control circuit board, and a second end of the second connecting wire is electrically connected to the battery.

6. The handheld fan according to claim 5, wherein a charging interface is disposed on the control circuit board for charging the battery; and the charging interface is externally exposed on the hand grip portion.

7. The handheld fan according to claim 5, wherein an operational button is disposed on the control circuit board, and the operational button is externally exposed on the hand grip portion.

8. The handheld fan according to claim 1, wherein the motor circuit board is a driving circuit board for the motor.

9. The handheld fan according to claim 1, wherein the motor further comprises a fan blade, the fan blade comprises a central connecting portion and peripheral blade portions, the fan blade is connected to a rear end of the rotor portion of the motor through the central connecting portion.

10. The handheld fan according to claim 9, wherein the stator portion of the motor comprises ventilation channels corresponding to the peripheral blade portions.

11. The handheld fan according to claim 1, wherein a rated rotational speed of the motor is not less than 20,000 PRM; and a power rating of the motor is not less than 35 W.

12. The handheld fan according to claim 1, wherein the handheld fan is a high-speed handheld fan.

* * * * *